US007358863B2

(12) United States Patent
Haney

(10) Patent No.: US 7,358,863 B2
(45) Date of Patent: Apr. 15, 2008

(54) DOUBLE BARREL CHEMICAL SEEKING SIDEWINDER GUN DEVICES

(76) Inventor: Marrell Haney, 1301 W. 96th St., Chicago, IL (US) 60643

( * ) Notice: Subject to any disclaimer, the term of this patent is extended or adjusted under 35 U.S.C. 154(b) by 0 days.

(21) Appl. No.: 11/518,376

(22) Filed: Sep. 7, 2006

(65) Prior Publication Data

US 2007/0210934 A1 Sep. 13, 2007

Related U.S. Application Data

(62) Division of application No. 11/122,307, filed on May 4, 2005, now Pat. No. 7,187,300.

(60) Provisional application No. 60/567,305, filed on May 4, 2004.

(51) Int. Cl.
*G08G 1/095* (2006.01)

(52) U.S. Cl. ..... 340/907; 340/999; 340/539.26; 340/517

(58) Field of Classification Search ..... 340/907
See application file for complete search history.

(56) References Cited

U.S. PATENT DOCUMENTS 6,085,576 A * 7/2000 Sunshine et al. ..... 73/29.01
6,473,002 B1 * 10/2002 Hutchison ..... 340/944
6,613,571 B2 * 9/2003 Cordery et al. ..... 436/48
6,627,154 B1 * 9/2003 Goodman et al. ..... 422/82.01
6,700,484 B2 * 3/2004 Bartholomew et al. ..... 340/531
6,842,009 B2 * 1/2005 Potter ..... 324/633
6,842,877 B2 * 1/2005 Robarts et al. ..... 715/708
6,867,044 B2 * 3/2005 Cordery et al. ..... 436/1
6,868,350 B2 * 3/2005 Zimmermann et al. ..... 702/65
6,943,343 B2 * 9/2005 Honjo et al. ..... 250/281
6,981,947 B2 * 1/2006 Melker ..... 600/532
7,034,677 B2 * 4/2006 Steinthal et al. ..... 340/539.12
7,051,577 B2 * 5/2006 Komninos ..... 73/40.5 A
7,052,468 B2 * 5/2006 Melker et al. ..... 600/532
7,151,815 B2 * 12/2006 Ruddy et al. ..... 376/158
7,171,312 B2 * 1/2007 Steinthal et al. ..... 702/32
7,188,513 B2 * 3/2007 Wilson ..... 73/31.05
2003/0201394 A1 * 10/2003 Peoples ..... 250/336.1
2004/0050188 A1 * 3/2004 Richards et al. ..... 73/866.3
2004/0220753 A1 * 11/2004 Tabe ..... 702/32
2005/0026276 A1 * 2/2005 Chou ..... 435/287.2
2005/0229698 A1 * 10/2005 Beecroft et al. ..... 73/300
2006/0226998 A1 * 10/2006 Wilson ..... 340/632

* cited by examiner

*Primary Examiner*—Benjamin C. Lee
*Assistant Examiner*—Eric M. Blount

(57) ABSTRACT

A large side vandal and weather resistant sign, capable of displaying images from several components, including a video cassette with tapes or video disc and other component parts for broadcasting command directions and to provide information. The sign system, with a front and back side and a left and right side is securely enclosed with a top side and a bottom side. The frame's materials include aluminum steel, and vandal and weather resistant plastics for the left and right sides and plastic sheets coverings for the front and back side door panels. In the event of a power outage, batteries are provided to ensure power for the system; it also remain constant in providing power for the sidewinder gun devices, sensors, receivers, timers and other devices which include surveillance camera, transmitters and relay devices. The large side sign system in adapted for mounting to utility poles, or by erecting a main near intersections that pivots vertically to a desired point or height that is required by municipal codes or regulations. A second pole is provided for pivoting horizontally to the center most part of the street as a source for attaching the main security system. There are spring-like motion and shock resistant devices having designs that will provide added protection for the security system during severe wind storms.

4 Claims, 6 Drawing Sheets

DOUBLE BARREL CHEMICAL SEEKING SIDEWINDER GUN DEVICES

RELATED APPLICATION

This is a divisional of U.S. patent application Ser. No. 11/122,307 which was filed on May 4, 2005, now U.S. Pat. No. 7,187,300 and entitled School crossing guard security system, and the disclosure of which is incorporated by reference.

| | |
|---|---|
| Int. Cl: | A47G,33/04 |
| U.S. Cl: | 445/22,428/7, 11, 40/594,564,584,340/04, D20/10 |
| Field of Search | 428/11,187, 40/584,248/223, 41, D20/10,29 340/901,445/22,40/538 |

| Prior Arts | | U.S. Patent Documents | |
|---|---|---|---|
| 1,368,144 A | February 1921 | Haughwout | |
| 1,994,937 A | March 1935 | Berger | 40/612 |
| D,161,150 | January 1950 | Burro | |
| 2,823,475 | February 1958 | Packard | |
| 2,046,044 A | June 1936 | Vissing | |
| 2,080,679 A | May 1937 | Vissing | |
| 3,590,508 | July 1971 | Jones et. al | 40/573 |
| 4,108,405 A | August 1978 | Gibson | 40/902 |
| 6,522,263 B2 | February 2003 | Jones | |
| 6,607,412 B2 | August 2003 | Mueller, et. Al | Foreign Arts |
| 450,602 | July 1936 | United Kingdom | |
| 1,375,813 | November 1974 | United Kingdom | |

BACKGROUND OF THE INVENTION

Field of the Invention

The present invention relates to an exterior school crossing guard security system that can be mounted on a pole combination that is attached in the center of streets or near sidewalks. A pole may be installed by pivoting it vertically to code specifications, and a second horizontal pole that is pivots pivoted inward to the center of the street where the system is attached. The multipurpose security system is preferably suited to aid or alleviate the need for crossing guards and other security personnel in the supervision of pedestrian and vehicular traffic. In addition, the present invention offers innovations for our security and education planners who must use new methods for serving and protecting the citizens of their states. In the mean time, the present invention with its video cassette, audio and video images and a highly specialized system of integrated sensors, receivers and timing devices are suitable for sniffing substance of dangerous gases, and detecting other dangerous chemicals, and will aid in the prevention of explosive materials in close proximity to schools and other public facilities and providing huge saving for municipalities throughout the world.

SUMMARY OF THE INVENTION

Accordingly, an object of the present invention is to provide an apparatus and methods for improving security at schools and other public and private facilities. The multipurpose sign security system is preferably attached or to special or utility poles in close proximity to large facilities and near intersections.

Another object of the present invention is to preferably installed attach chemical detecting sidewinder guns which are also detachable and are suited for use in cars and other locations.

A further object is to construct the sign system with materials such as flat aluminum metal bars approximately 2 inches wide for the left and right side borders, and aluminum flat 1-shaped corner bars with grooves that are suitable for inserting the sheets of vandal resistant plastics at each border of the sign. The sign system is preferably 4 feet high, 2 feet wide and the front and back plastic sheet covers incased at each frame border with thin aluminum metal flat bars that are suitable for attaching small metal hinges for each door. The corner bars may require welding as a way for joining the corner and side bars. Means of egress for each side of the unit can be achieved by using the hinged method. Aluminum steel or plastics are suitable materials for the top and bottom sections of the unit. A variation of sizes and dimensions are suited for compliance in meeting some municipal code specifications. Accordingly, suitable materials for construction of the frame will consist of 4 flat preferably grooves-type metal bars being approximately 2 inches wide with 4 flat metal bars being about 1 inch wide to be used with approximately four feet long horizontal bars. And further, 4 vertical bars are being approximately 1 inch wide and 4 horizontal bars being approximately 1 inch wide that are suitable border fasteners in the event that grooved bars are not used. Additional materials such as locking devices, screens, door hinges and sealer substance materials to prevent corrosion inside of the system are recommended.

The other components to the present invention are two smaller version of the larger model which is preferably attached on stop and light poles. A combination of two metal poles that are preferably attached to curbsides with the base pole pivoting vertically to about 20 feet and a second pole that is pivoted inward to the center of the street to be used as a retainer pole for the security system.

Some component parts to be installed inside of the system are surveillance and video cameras screen units, speakers, receivers, timers, relays, transmitters, videos, video cassettes and rechargeable batteries to be used as a second power source during electrical power failures. The video devices are preferably suited for broadcasting directions, messages and information to motorists' pedestrians and a central station where transmitted data are tested and analyzed.

The pole models are preferably constructed of with aluminum steel flat bar panels with each having approximately 12 inches in width with a left and right metal frame border line or side bars that are perpendicular to the upper most part of the unit. Each flat bar is preferably designed with 1 inch grooves capable of retaining ½ inch vandal strength plastics. Another method for securing the plastic door covers is by using materials such as thin metal plates and tamper proof metal screws. Finally, the third component of the security system is a central station where receiving data, analyzing it and making decisions including gathering of information and keeping records of all occurrences are performed.

The fourth component of the security system is the chemical seeking sidewinder guns. These devices that are equipped with an integrated array of devices such as high tech sensors, receivers, transmitters, indicator and relay devices along with switches and detectors such as scanners and x-ray devices are preferably suited for detecting, isolating and providing an accurate identification of a targeted substance.

BRIEF DESCRIPTION OF THE DRAWING

FIG. 8 is a perspective showing a metal specialized clamp that is provided as a connecting device for vertical and horizontal poles.

FIG. 9 is a perspective view of a specialized clamp for connecting pole components.

FIG. 10 is a perspective view showing clamps that are provided for use on utility and light poles to attach the smaller security systems.

FIG. 11 is a perspective of a vertical and horizontal components for attaching school crossing guard security systems.

DETAILED DESCRIPTION OF THE DRAWINGS

Figure 1:
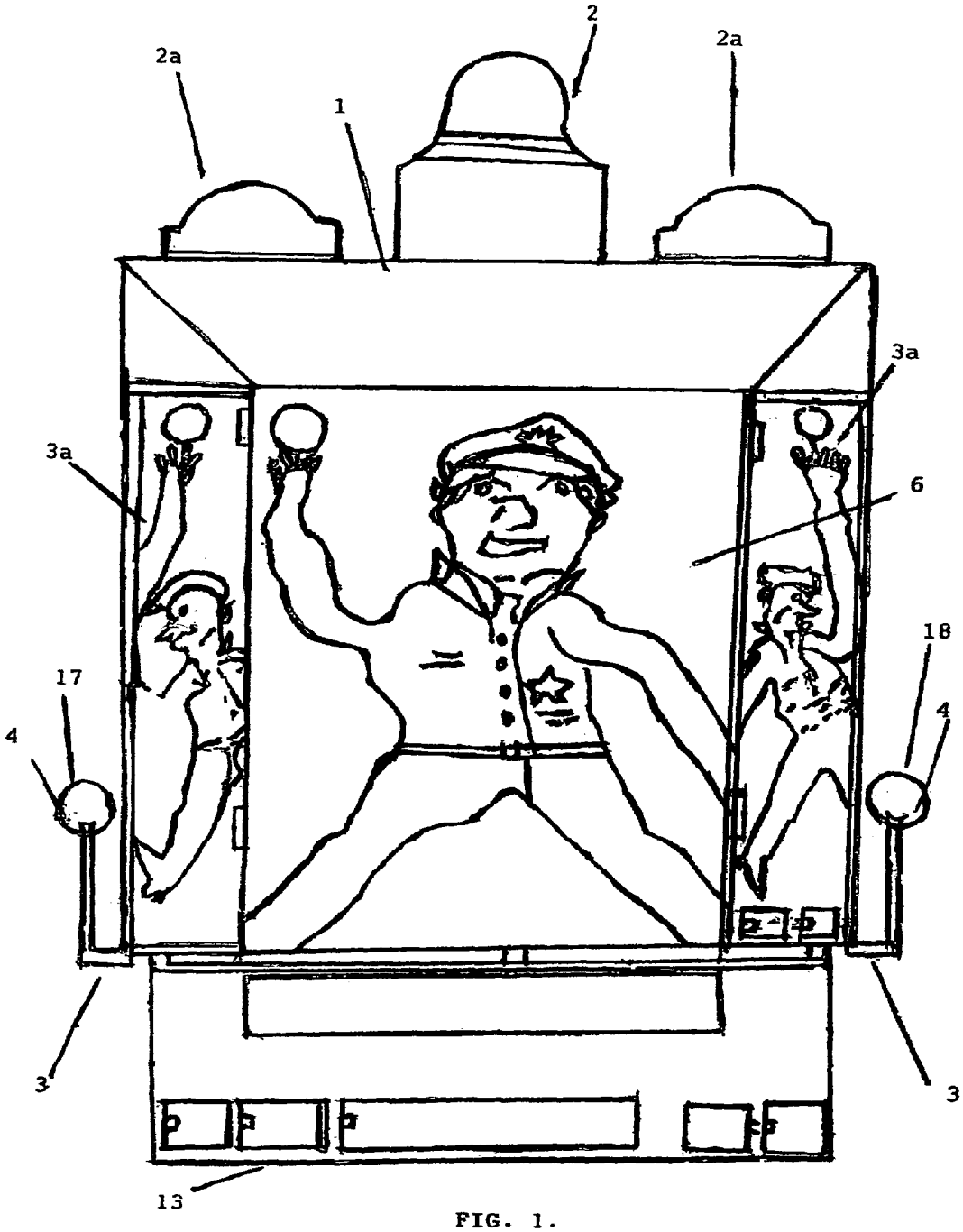
FIG. 1 is a perspective view of a weather and vandal resistant security system having a front and back side and a top and bottom side. The sign unit is preferably constructed of with vandal resistant plastics and aluminum metals.

Referring now to the drawings in FIG. 1 is a school crossing guard security system, and is generally indicated at 1, and showing the present invention in preferred drawings in which a box-like sign system FIG. 1 is provided with a front side view and a back side view and included is a left side view and a right side view. The school crossing guard security system 1 which comprises aluminum steel, fiberglass, plastics materials can be assembled through a process of welding, molding, metal screws bolts and the like for joining together the frame's horizontal and vertical bars including brackets, cross bars and corner bars. Operational component parts and devices include sealers, electricity, rechargeable batteries, transformers and the like for the present invention.

Referring again to FIG. 1 is a perspective view of the present invention and depicted in windows 3*a* are left and right side views of video images of security guards, and provided in 6 on the front side and 6*a* (not shown) or the back side are identical video images of security guards. The use of video cassettes having timers, switches and the like are required. Provided in invention 1 of FIG. 1 are video audio messages including information and directions for motorists and pedestrians. Due to certain guidelines of municipalities including code specifications, the size and dimensions of the system is adapted to meet compliances. But in general the system should have a preferred measurement of 5 feet in width, 4 feet in height and 3 feet deep measurement from the front side to the back side of the cabinet. The construction of the frame should consist of 4 horizontal cross bars of a flat composition being approximately 3 feet long and 4 vertical corner bars with measurement of approximately 4 feet. All bars should have a preferred measurement of 2 inches in width. The bars should have a diametrical measurement that is suitable to accommodate sheets of vandal resisting plastics and the like. Each frame bar must be designed with in-lay grooves that provide enough space for inserting plastic window cover sheets. Corner brackets, facings, sealants and the like are to be used for weather proofing and for frame reinforcement.

Figure 2:
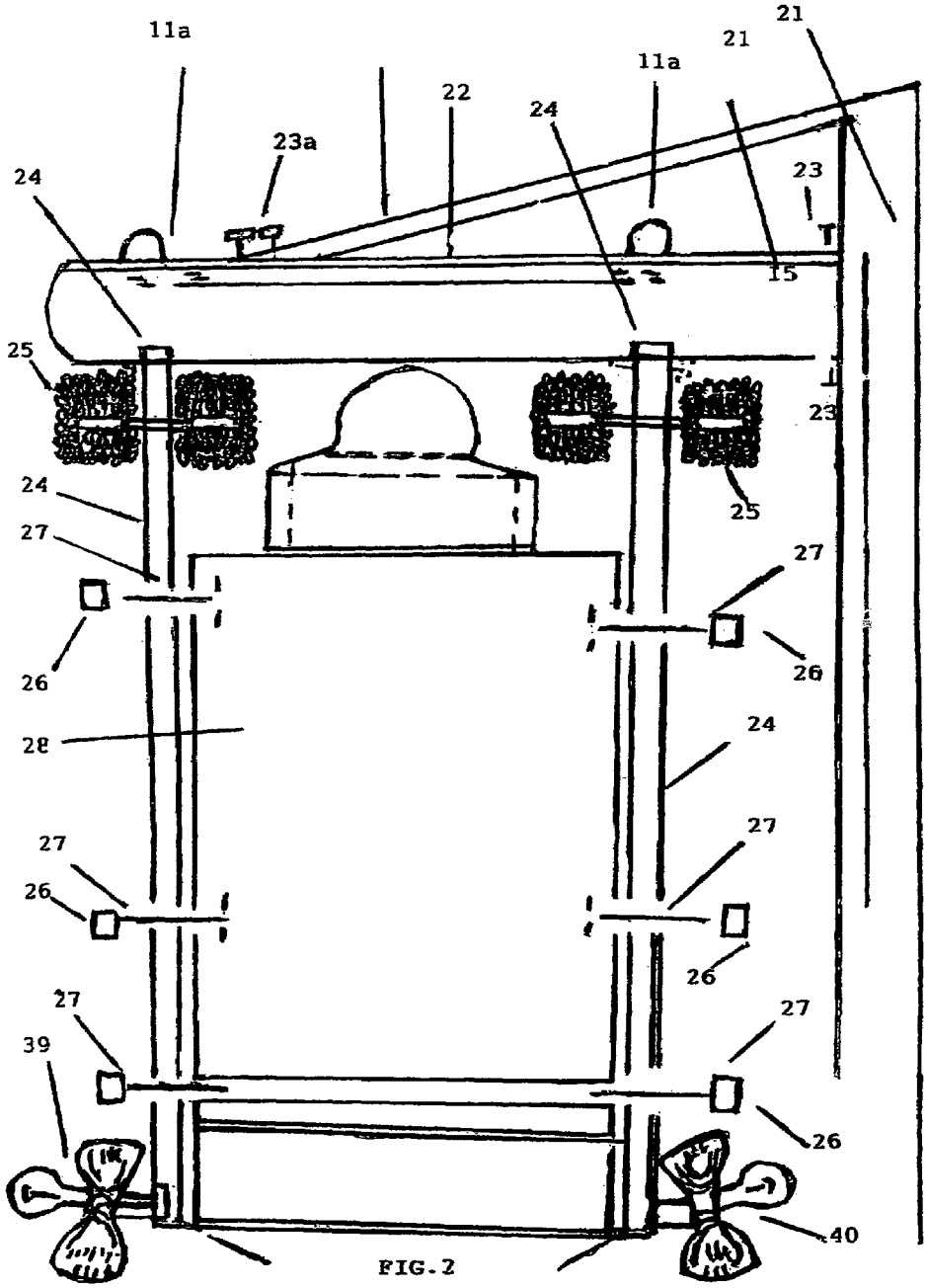
FIG. 2 is an exploded view of the school crossing guard security system showing a rotating dome light at the top. The chemical seeking sidewinder guns being attached near the bottom section of the system have electricity as their first power source and electric charged batteries as the second power source to be used during electric power failures.

Metal hinges being approximately 3 inches wide are preferred for joining the several doors. The doors should open perpendicular to a level plane in order to provide a work area for occasional repairs. Plastic rotary dome lights 2 and 2*a* are adapted to be programmed by timing devices on an intermitting schedule and during emergency occurrences. The dome lights having aluminum or plastics bottoms may be enclosed with a preferred metal ring around the base. Dome lights 2*a* are adapted to blink as the center rotary light 2 rotates. Similarly the lights 17 on the left side and 18 on the right side are adapted to revolve as they blink, and each being activated by timing devices. The lights 17 and 18 are erected on 1 inch, round rods that pivot 12 inches vertically front their base. Each rod having electric wirings that is threaded through extension bars are about 12 inches from the exterior base which is on each side of the lower cabinet and are threaded upward through rod 3 and onto light fixture 4. Again, materials that are suitable for use in building the main unit 1 and pole models 32 are aluminum steel, plastic, metal screws and metal nuts. Also, welding and molding are processes that maybe utilized as a way of connecting parts together. The lower cabinet 13 having a width of approximately 1½ feet and including a depth of 3 feet is adapted for housing most devices including switches, relays, timers, batteries and other devices. The lower cabinet having an aluminum door that is joined to cabinet 13 with metal hinges is adapted to open perpendicularly to a level plane, and thereby providing an occasional work area. Materials for framing and enclosing the lower cabinet 13 are preferably 4 flat horizontal bars being approximately 5 feet long and 4 vertical corner flat bars being approximately 1½ feet long and 4 flat horizontal cross-bars with measurements of approximately 3 feet long. Two aluminum sheets measuring, 1½ feet by 5 feet are preferably used for enclosing the front side and the back side of lower cabinet 13. Referring to FIG. 2 is a perspective showing a metal pole combination 21 and 22. Pole 21 should pivot vertically to approximately 18 feet and having a horizontal extension pole 22 for retaining invention 1. There are two aluminum steel bars 24 being diametrically the same, and having a width and thickness of approximately 2 inches for frame bars and intended for securing system 1 with metal bolts 27 and metal nuts 26. Lower cabinet 13 is adapted with shock absorber devices 25 which can provide additional protection for main system 1 during severe wind storms with mechanisms adapted for stopping the system on a horizontal plane as viewed from the point of extension/retainer pole attachments 11*a* and thereby providing a lesser direct impact from violet winds. Pole 21 can be installed near an intersection between sidewalks and curbs with heights of 18 feet with a horizontal connection to retainer pole 22 with metal bolts and clamp devices. Connecting the main vertical pole 21 to retainer pole 22 is achieved at section 23 with clamps and bracket devices. A support bar 48 attaches to retainer pole 22 at section 23*a*. The sidewinder gun devices 39 and 40 are adapted for attaching to lower cabinet 50 with an assortment of devices including metal nuts and bolts.

Figure 3:
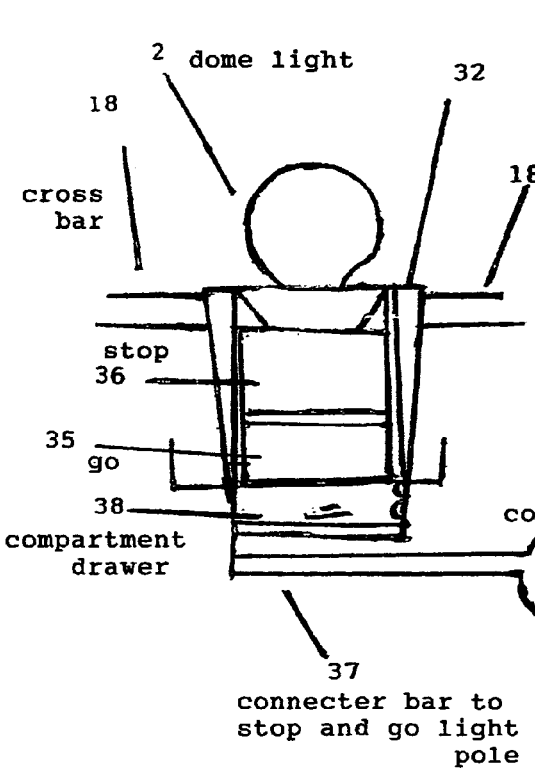
FIG. 3 shows a perspective view of two pole models of the school crossing guard security system and also equipped with audio, cameras, video cassettes, switches, and timing devices with a complete package of component parts.

Referring to FIG. 3 is a pole model crossing guard security system having specialized functions. Pole model FIG. 3 is adapted for utility poles including stop and go light poles, and can be programmed to function in tandem with main school crossing guard security system 1 or other planned schedules. Materials suitable for building the pole model consist of aluminum steel, plastics, tamper proof 1, ½ inches metal screws or welding for joining together the frame. Metal clamps 29 in FIG. 8 and 9 are suitable for connecting pole model with clamps at section 37 a cross bar device, and are suited for utility pole connections by wrapping clamping devices around utility poles. Pole model 32 of FIG. 3 in accordance to the present invention is provided with rotary blinking done light 2, stop light 35, go light 36 and video information in side bars 18. A utility drawer having rollers 38 within the utility cabinet 13 is provided with space for batteries, switches, relays, transformers and other devices. A variety of metal clamps are suited for connecting the system 32 in FIG. 3 to utility poles. A video cassette is also provided with other devices including sensors, transmitters and receivers.

Figure 4:
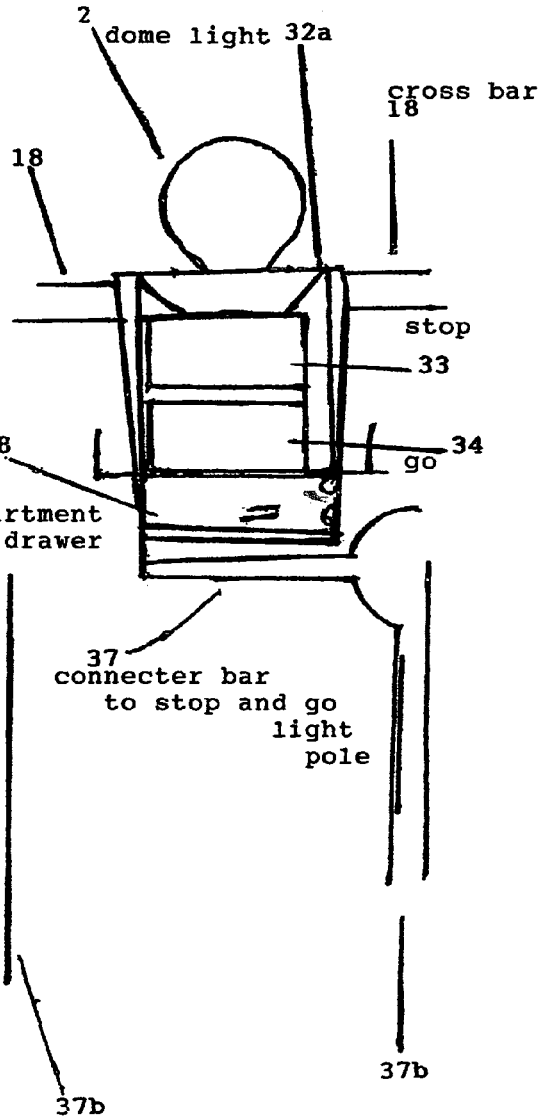
FIG. 4 is a perspective showing a pair of chemical seeking sidewinder guns that are suitable for detecting and identifying dangerous substances that could be used for explosive such as bomb making materials.

Referring to FIG. 4 is a pole model school crossing guard security system having identical functions, parts And devices as 32 of FIG. 3. However, pole model 32*a* in FIG. 4 is also provided with a stop light 34, a go light 33, rotary dome lights 2*a* and cross bars 18*a* which are adapted for video messages. The drawer compartment cabinet 38*a* in a slide out component having rollers, and can accommodate batteries, timers, transformers, relays, switches and other component devices. The pole model 32*a* of FIG. 4 is suited for connecting to utility poles with metal clamps and other devices. Both pole models 32 of FIG. 3 and pole model 32*a* of FIG. 4 are suitable for connecting to utility poles with metal clamps and other devices. Materials that are suitable for building both pole model security system 32 in FIG. 3 and 32*a* in FIG. 4 are aluminum steel flat 1½ inch in-lay bars for inserting and retaining aluminum sheets or the door sheets may be joined to the frame with metal hinges. Four flat frame bars at approximately 18 inches in length with thickness of about ¼ of an inch and measuring 1½ inches with. Horizontal bars being about ¼ of an inch thick an 1½ inches wide should be approximately 18 inches in length to be used for framing parts for both pole model systems 32 of FIG. 3 and pole model system 32*a* of FIG. 4.

The drawer compartment cabinet as seen in 32 of FIG. 3 and 32*a* of FIG. 4 are suitable for housing parts and devices including batteries, timers, cameras and sensors. Metal screws and metal nuts or welding are suitable ways to join together various parts for the pole model systems. Cross bar 18 of FIG. 3 and 18*a* of FIG. 4 should pivot about 12 inches horizontally from the frame of FIG. 32 of FIG. 3 and FIG. 18*a* of FIG. 4. Cross bars 32 and 32*a* are adapted for bars designs that are suitable for video cassette messages.

Figure 5:
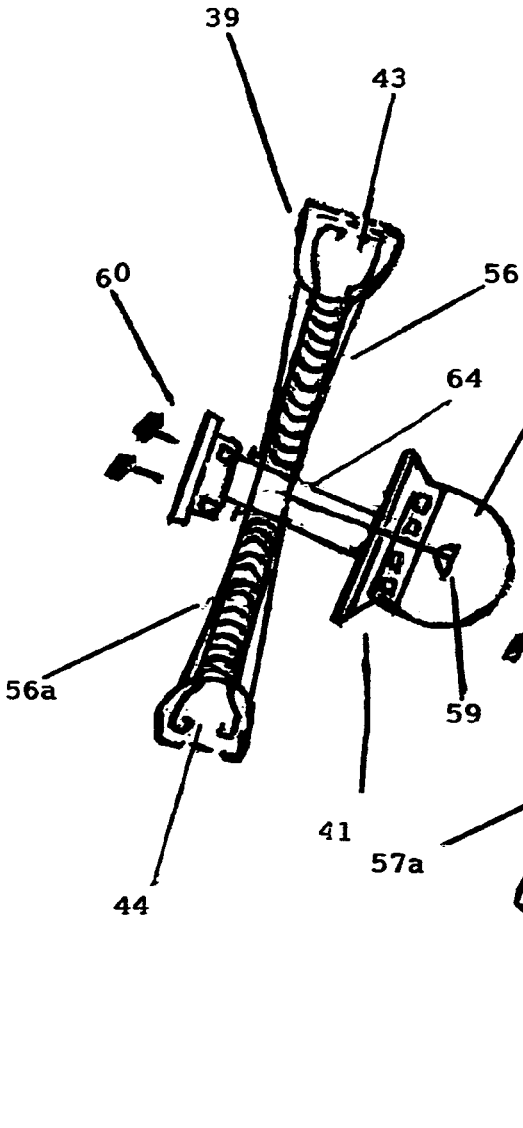
FIG. 5 is a perspective view showing a plurality of metal brackets and clamping devices that are preferably suited for attaching the pole models security system to utility poles including stop and go light poles.
Figure 6:
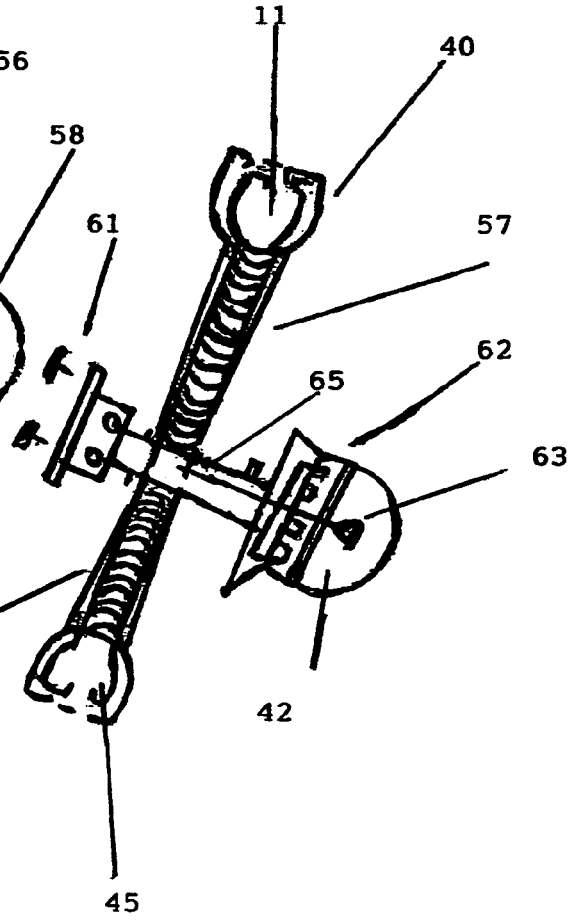
FIG. 6 is a schematic perspective view of numerous electrical devices that are suited for usage in an integrated system for detection, receiving and transmitting data to central station where the data is identified and official decisions are made.

Referring to FIG. 5 is a perspective of a sidewinder gun device 39 having mechanisms that provide for the detecting of certain dangerous chemicals through a system of integrated devices including snifters, and other highly specialized sensors. These detectors within the sidewinder guns 39 and 40 of FIG. 5 and 6 are suitable for detecting and selecting substances for further scientific analysis which is determine at a central station. The main power source for the double barrel chemical seeking sidewinder gun devices 39 and 40 are also functional when receiving power from batteries. Although the sidewinder gun devices are a major component for the main school crossing guard security system, and they designed to function in a detachable mode.

Figure 12:
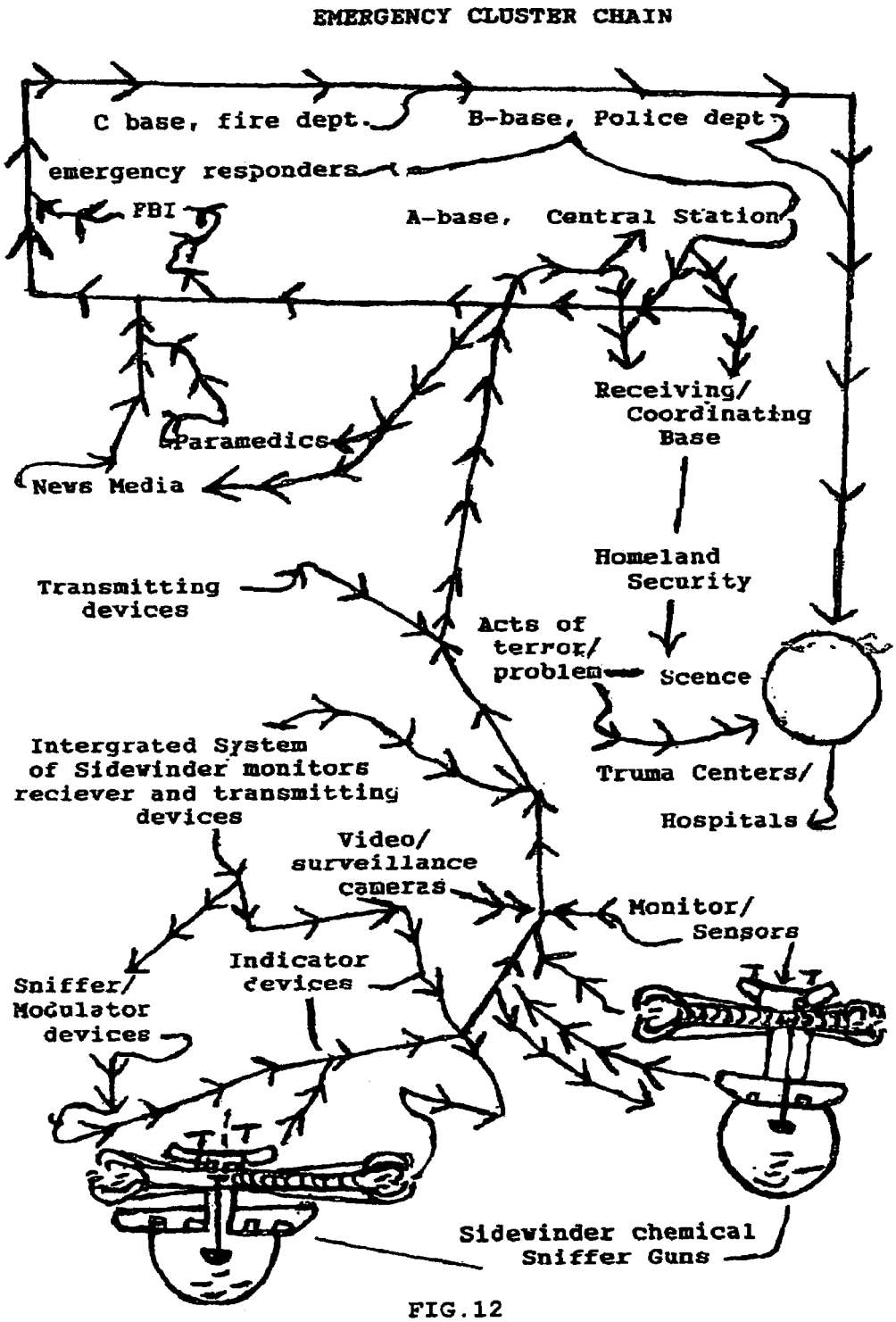
FIG. 12 is a perspective view of a schematic drawing of an imaginary plant that is followed during terrorists activities that involve explosive materials.

Whenever the sidewinders detect data which indicates substances that can be used to make explosive devices similar to bombs, the data is transmitted by transmitting devices to technicians at central station FIG. 12 where official determinations and action are taken. The sidewinder guns 39 and 40 connect onto the bottom frame bars 24 of the main invention 1 on the left side 50 of FIG. 2 and the right side 50*a* of FIG. 2. Each device is adapted to snap into metal brackets that extend out on each side of the system.

Referring to FIG. 6 is a perspective of a double barrel sidewinder gun device 40 which is identical to the sidewinder gun device 39 in FIG. 5, and it has the same functions that are provided in sidewinder gun device 39. The double barrel features 57 and 57*a* FIG. 6 are intake tubes adapted for receiving gases being detected from sniff devices 11 and 45 to be examine through a process that is performed in the analytical unit of the sidewinder gun devices.

Figure 7:
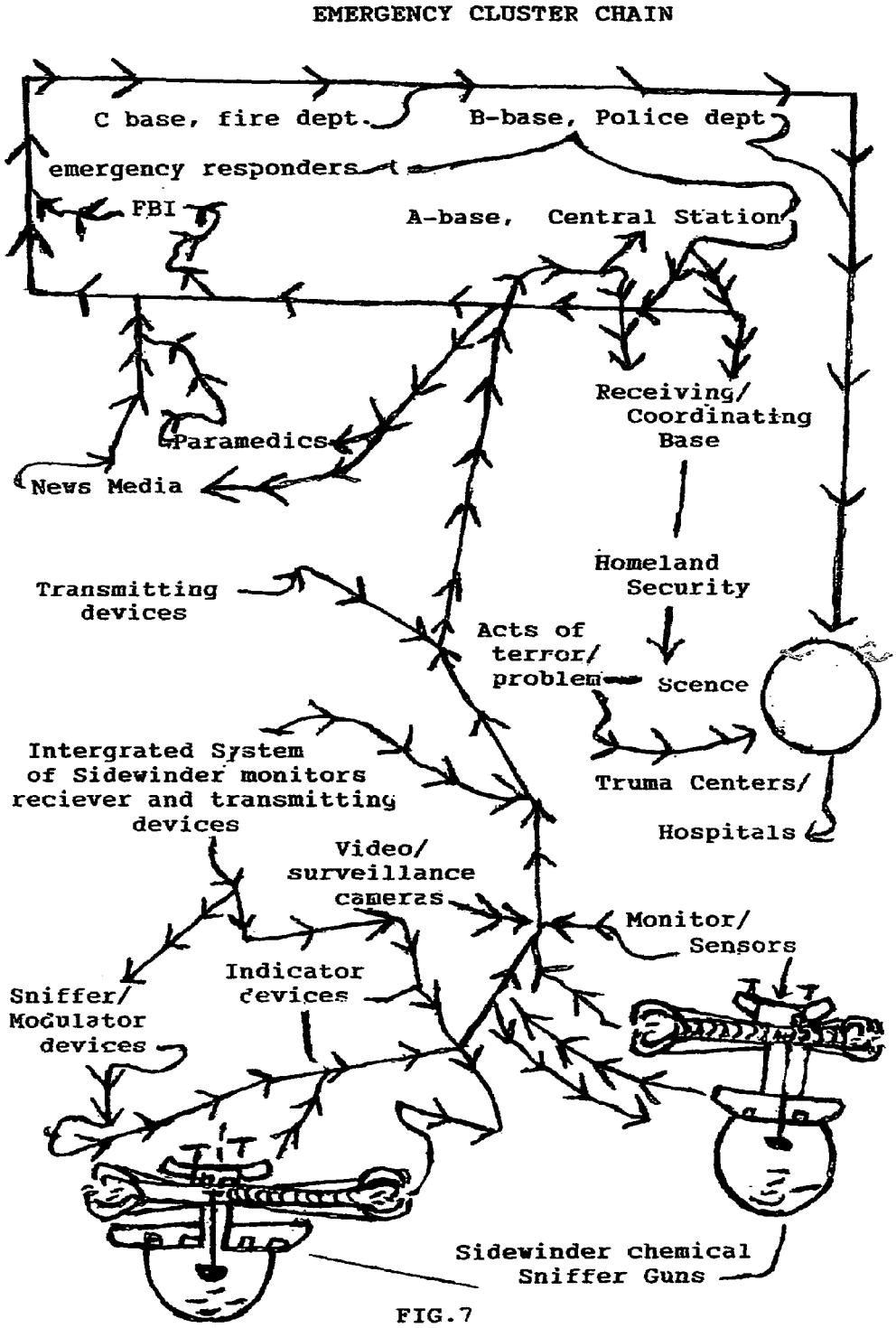
FIG. 7 is a perspective of a time line incorporated into a cluster chain of events that are preferably used in the prevention of car bombing and other terrorist acts.

Referring to FIG. 7 is a perspective view of a retainer pole 22 which may be used as an extended component to metal pole 21 FIG. 2 as a source for attaching invention 1.

Referring to 29 as seen in FIG. 8 and FIG. 9 are metal clamping devices that are suitable for securing pole models 32 and 32*a* in FIG. 8 and 9.

FIG. 10 are metal clamps 47, and being smaller versions are also suitable for use in securing pole model security system to various utility poles.

Referring to FIG. 11 is a perspective view of a curbside pole 46 having a component pole 20. Metal pole 46 is a vertical design that may be installing attached near curbsides and pivots up to a desired point to be connected to retainer 20 which is adapted to pivot horizontally to a desired locations for attaching pole models FIG. 3 and FIG. 4 or it could be used to installed a smaller side size main security system 1.

Referring to FIG. 12 is a schematic drawing of an imaginary plan that follows a pattern of action based on emergencies that are, or may occur following detection or detonating of explosive devices including bombs. Materials that are preferably used to build the double barrel chemical detecting sidewinder gun devices are metal and plastics. Parts for constructing the school crossing guard system should include sealants, metal and plastic tubing for sections 11, 43, 44 and 45 in FIG. 5 and FIG. 6 in order to more completely complement various dependent components.

What is claimed is:

1. A double barrel chemical seeking sidewinder gun device comprising:

high-tech chemical seeking sensor devices within the double barrels of said double barrel gun device;

an analytical unit to detect and isolate poison gases and explosive materials in interior and exterior environments through the use of switches, receivers, sensors, and transmitter;

said double barrel gun device being physically attached to a school crossing guard sign in a school crossing guard security system as means to discourage and prevent terrorist acts;

said double barrel gun device further being detachable from said school crossing guard security sign and operable in a portable manner within a vehicle as means to discourage and prevent terrorists acts; and an integrated system of said gun devices comprising high-tech component devices for detecting and recording chemical data and transmitting samples of said data to a central station for further testing by trained technicians.

2. A double barrel chemical seeking sidewinder gun device comprising an analytical unit according to claim 1, said analytical unit further comprising:

means for recording, detecting and identifying data through the use of sensor-laden metal or plastic intake valves, gauges, receivers, relays, sniff sensors, and transmitters.

3. A double barrel chemical seeking sidewinder gun device comprising high-tech component devices according to claim 1, said high-tech component devices further comprising:

chemical seeking devices with approximately 12 inch barrels having adjustable ranges for positive detections of poison gases and explosive materials.

4. A double barrel chemical seeking sidewinder gun device according to according to claim 1, further comprising:

a plan for direct action by trained technicians, Homeland Security, the local police, and emergency first responders upon identification and transmission of data to a central station by the chemical seeking sidewinder gun device indicating high levels of poison gates and explosive materials.

* * * * *